US006050618A

United States Patent [19]

Tieu

[11] Patent Number: 6,050,618

[45] Date of Patent: Apr. 18, 2000

[54] SLIDE LATCH

[75] Inventor: Loc B. Tieu, Upper Darby, Pa.

[73] Assignee: Southco, Inc., Concordville, Pa.

[21] Appl. No.: 09/063,130

[22] Filed: Apr. 20, 1998

[51] Int. Cl.[7] ..... E05C 1/10

[52] U.S. Cl. ..... 292/175; 292/145; 292/DIG. 30; 292/DIG. 38; 292/DIG. 53

[58] Field of Search ..... 292/175, 120, 292/128, 162, DIG. 30, DIG. 38, DIG. 53, DIG. 63, 145

[56] References Cited

U.S. PATENT DOCUMENTS

| | | | |
|---|---|---|---|
| 3,841,674 | 10/1974 | Bisbing et al. . | |
| 3,850,464 | 11/1974 | Bisbing et al. . | |
| 4,138,151 | 2/1979 | Nakao | 292/DIG. 38 |
| 4,320,834 | 3/1982 | Tamaki | 292/175 |
| 4,790,579 | 12/1988 | Maxwell et al. | 292/175 |
| 4,818,003 | 4/1989 | Seko et al. | 292/DIG. 38 |
| 5,121,952 | 6/1992 | Jason | 292/175 |
| 5,158,329 | 10/1992 | Schlack | 292/DIG. 46 |
| 5,358,291 | 10/1994 | Malmanger et al. | 292/175 |
| 5,482,333 | 1/1996 | Gerhrs et al. . | |
| 5,603,535 | 2/1997 | Antonucci et al. | 292/DIG. 46 |
| 5,628,534 | 5/1997 | Morgan . | |
| 5,878,608 | 3/1999 | Alyanakian | 70/208 |
| 5,897,147 | 4/1999 | Alyanakian et al. | 292/175 |
| 5,934,115 | 8/1999 | Bernier et al. | 70/208 |
| 5,934,716 | 8/1999 | Koveal et al. | 292/175 |
| 5,994,842 | 11/1999 | Schlack et al. | 70/208 |

OTHER PUBLICATIONS

Southco, Inc. Handbook 45 NA, pp. G–8 and G–9.

*Primary Examiner*—Teri Pham
*Attorney, Agent, or Firm*—Paul and Paul

[57] ABSTRACT

A sliding-action slam latch includes an integrally molded rearwardly curving leaf spring for engaging the door panel in which the latch is mounted. A recess in the underside of the latch permits free travel of the leaf spring as the latch is opened.

16 Claims, 3 Drawing Sheets

SLIDE LATCH

BACKGROUND OF THE INVENTION

1. Field of the Invention

The present invention relates generally to latching devices, and more particularly to systems for latching hinged doors or panels and the like.

2. Background of the Invention

Various types of latching devices for fastening doors, panels and the like are known.

Door-mounted "slam" latches employ a camming surface on the end of a sliding-bolt element which cooperates with a striker on the door frame to cause a bolt action to secure the door when it is closed against the frame. Such latches are activated to secure the door when the door is merely pushed shut or slammed. However, operation of the latch mechanism is required to release the latch to open the door. In some slam latches, the bolt is urged against a spring force by the action of a camming surface cooperating with the striker to slide into the latch housing as the door is being closed. The spring force then urges the bolt element to engage behind the door frame or to engage a keeper mounted on the door frame once the camming surface has passed the door frame inner surface. In order to open the door, the bolt is manually operated, usually through a grip, to withdraw the bolt from engagement with the keeper so that the door can be swung open.

Examples of prior art slam latches are disclosed in U.S. Pat. Nos. 3,841,674, 3,850,464, 5,482,333 and 5,628,634.

The spring force for such latches can be provided through separate spring elements, such as by a torsion bar spring (FIGS. 8–9, U.S. Pat. No. 3,841,674), by a torsion coil spring (FIGS. 11–13, U.S. Pat. No. 3,841,674), or by a compression coil spring (FIG. 13, U.S. Pat. No. 3,841,674). Alternatively, the spring element can be integrally molded with a latch body made from an appropriate plastic or polymeric material (FIGS. 1–7, U.S. Pat. No. 3,841,674; U.S. Pat. No. 5,842,333; FIGS. 6A–6E, U.S. Pat. No. 5,628,534).

Slam latches with integrally molded spring elements have a number of advantages over slam latches which use separate metal springs. First, slam latches with integrally molded spring elements tend to be less expensive because fewer parts are required to be made and assembled for each latch. Further, metal springs may become embrittled during manufacture and thus subject to breakage.

On the other hand, prior art latches with integrally molded spring elements may not have the same life expectancy as those which use separate metal springs. Elements formed from polymeric materials which are subjected to cyclic stresses, such as integrally molded spring elements in slam latches, sometimes fail at stress levels far below their yield stress, due to fatigue failure.

Prior slam latches have employed generally planar integrally molded spring elements. Examples include those shown in FIGS. 1–7 of U.S. Pat. No. 3,850,464, and FIGS. 6B–6E of U.S. Pat. No. 5,628,534. A variation is disclosed in U.S. Pat. No. 5,482,333, in which the spring member 5 includes two pair of integrally hinged generally planar elements, molded from a suitable resin, such as polypropylene, in a relaxed configuration. In each of these designs, when the latch is operated stresses are generated primarily proximate the portion of the latch where the spring extends from the latch body.

There is a need for a simple, inexpensive slam latch having an integrally molded spring element which resists cyclic stresses and fatigue failure.

SUMMARY OF THE INVENTION

The present invention provides a latch of the sliding-action slam type for installation in an opening in a door panel for releasably retaining the door panel relative to a frame. The latch has a forward section, a main section having a bottom; a rear section; and a peripheral flange for engaging the top of the door panel proximate the opening. For installation purposes, the latch has a shaped recess in the forward section for receiving cooperatively the forward edge of the panel opening. The latch's forward section has a first portion which projects forwardly beyond the shaped recess for retaining the latch body in the panel. This portion of the forward section also serves to guide the latch body in its back-and-forth sliding action. The forward section also has a second portion which projects forwardly beyond the first portion. This second portion is adapted to cooperate with the frame when the latch body is in its closed position to latch the door panel. The second portion preferably incorporates a slightly angled surface to ensure a positive engagement with frame such that the latch is prevented from rattling and vibrating. The rear section has a leg element which has a first section extending generally rearwardly from the bottom of the main section. The leg element also has a second section which extends generally upwardly from the first section. This second section is spaced rearwardly from the main section of the latch body as well as downwardly from the flange. The second section is adapted to engage the bottom of the panel proximate the rear edge of the panel opening. Finally, the latch also has a spring for biasing the latch body forwardly toward the closed position. The spring extends upwardly from the first section of the leg element, in between the main section of the latch body and the second section of the leg element. The spring is adapted for engaging the rear edge of the panel opening. Preferably, the spring is integrally formed with the latch, and takes the form of a leaf spring extending in a generally planar form from the leg element, and curving rearwardly. It is also preferred that the underside of the flange be recessed to permit free travel of the spring as the latch moves between an open position and a closed position. The latch preferably includes a well formed in the main section for receiving the finger of an operator. An ergonomic contour for the inside of the well is preferred.

Preferably, the latch is formed from a polymeric material, such as by molding from a synthetic acetal resin which is resistant to cyclic loading. This extends the duty life of the integral spring and thus the latch.

DETAILED DESCRIPTION

Figure 1:
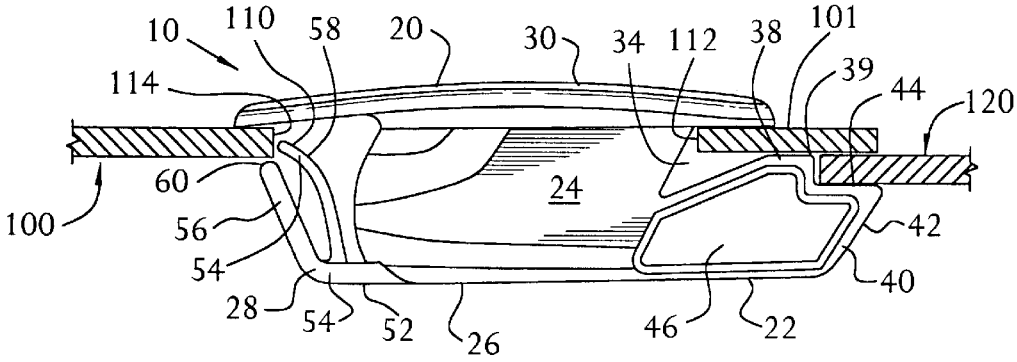
FIG. 1 is a side elevational view of a slide latch of the present invention, the slide latch being shown mounted in a panel and in a latch position securing the panel to a frame, the panel and frame being shown in cross-section.
Figure 2:
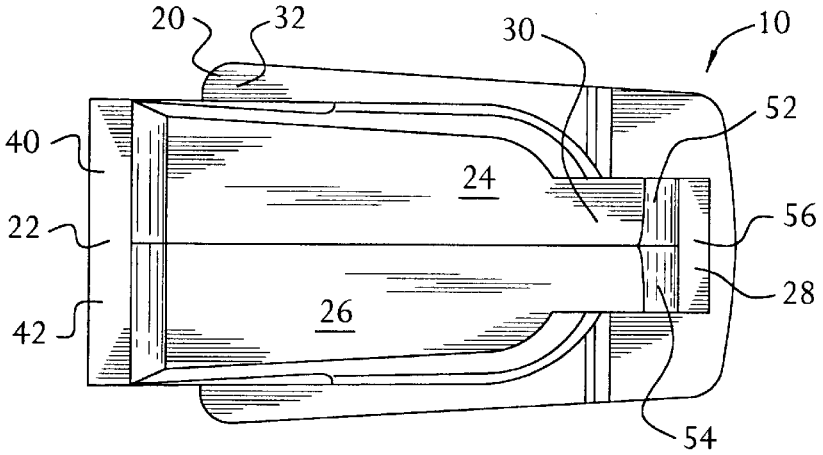
FIG. 2 is a bottom plan view of the slide latch of FIG. 1.
Figure 3:
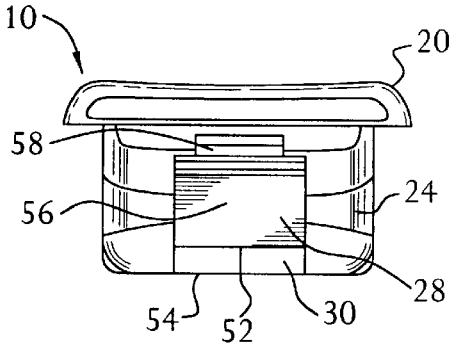
FIG. 3 is a rear elevational view of the slide latch of FIG. 1.
Figure 4:
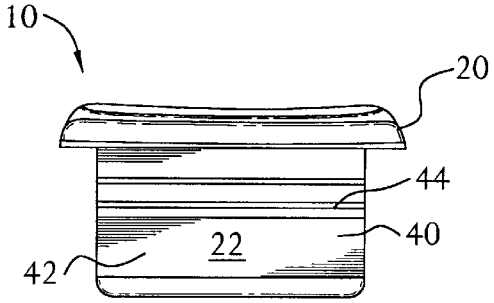
FIG. 4 is a front elevational view of the slide latch of FIG. 1.

Referring now to the drawings in detail, wherein like reference numerals indicate like elements throughout the several views, there is shown in FIG. 1 a side elevational view of a latch 10 of the present invention mounted on a door panel 100 and securing the door panel to a frame 120, the door panel 100 and frame being shown in a fragmentary section thereof. The latch 10 includes a latch body 20, preferably formed as a single component by a molding process from a polymeric material having substantial resistance to fatigue from cyclic loading. A particularly preferred polymeric material is acetal resin, available as Delrin® acetal resin from E. I. du Pont de Nemours, Wilmington, Del.

The latch body 20 includes a forward section 22, a main section 24, and a rear section 28, as well as a flange 30 formed at the top of the latch body 20.

The forward section 22 includes a shaped recess 36 adapted for installation of the latch body 20 in the door panel 100 as described in detail below. The forward section 22 has a first portion 38 which projects forwardly beyond the shaped recess 36 for retaining the latch body 20 in the panel 100. This first portion 38 of the forward section 22 also serves to guide the latch body 20 in its back-and-forth sliding action. The upper surface 39 of the first portion 38 is spaced downwardly from the underside 32 of the flange 30 thus forming a gap sized to receive the door panel 100 proximate the forward edge 112 of the opening 110 in the panel 100 when the latch 10 is installed in the panel 100. The forward section 22 also has a second portion 40 which projects forwardly beyond the first portion 38. This second portion 40 is adapted to cooperate with the frame 120 when the latch body 20 is in its closed position to latch the door panel 100. The second portion 40 includes an angled camming surface 42 for displacing the latch body 20 into an open position when the door panel 100 in which the latch body 20 is slammed shut. The second portion 40 also includes a guide surface 44 adjacent the camming surface 42 for securing the door panel 100 to the frame 120 when the latch body 20 is in a closed position and the door panel 40 is latched to the frame 120. The guide surface 44 is oriented at a slight downward angle with respect to the plane of the frame 120 so that when the latch 10 is released the guide surface 40 cams the panel 100 against the frame 120, thereby reducing or eliminating vibration and rattling of the door 100 against the frame 120. The forward section 22 is formed with a tubular aperture 46 extending traversely therethrough, for providing strength and rigidity to the forward section 22 while reducing weight and material costs.

Figure 7:
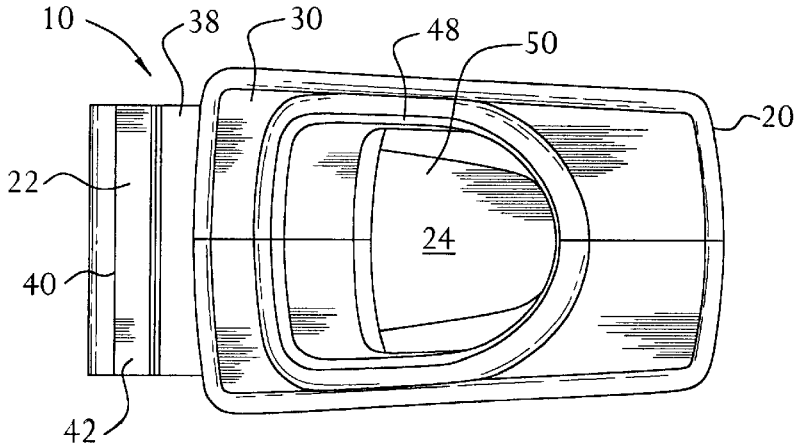
FIG. 7. Is a top plan view of the slide latch of FIG. 1.

The main section 24 of the latch body 22 includes a shaped aperture or well 48 for receiving the finger of an operator of the latch 20. As best seen in the perspective view of FIG. 5 and the top plan view of FIG. 7, the interior surface 50 of the well 48 is ergonomically shaped so that an operator can easily and comfortably apply sufficient force to displace the latch body 22 from a closed position (shown in FIG. 1) to an open position (shown in FIG. 9) to unlatch the door panel 100 from the frame 120.

Figure 5:
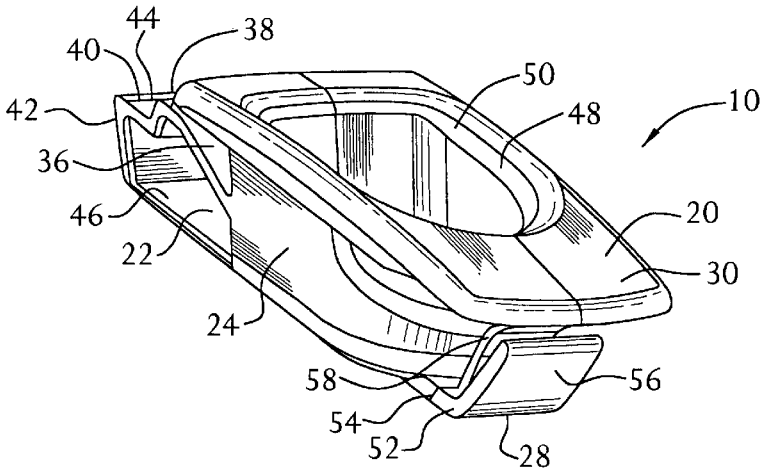
FIG. 5 is a perspective view of the slide latch of FIG. 1 as seen from above and to the front of the right side of the latch.
Figure 6:
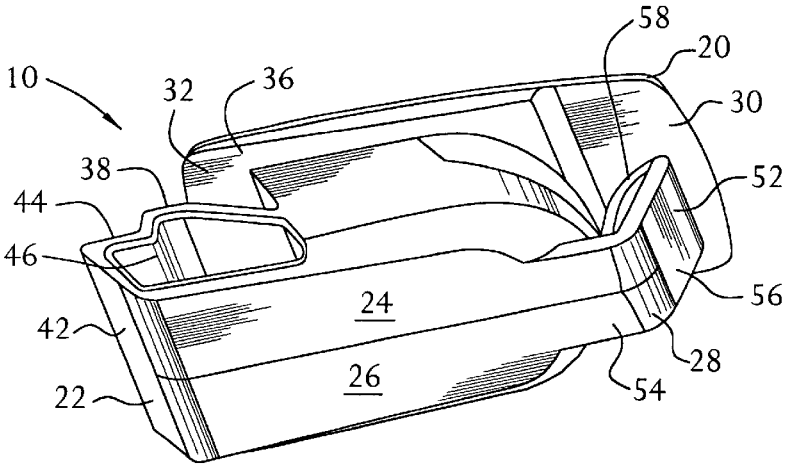
FIG. 6 is a perspective view of the slide latch of FIG. 1 as seen from below and to the left of the bottom of the latch.
Figure 8:
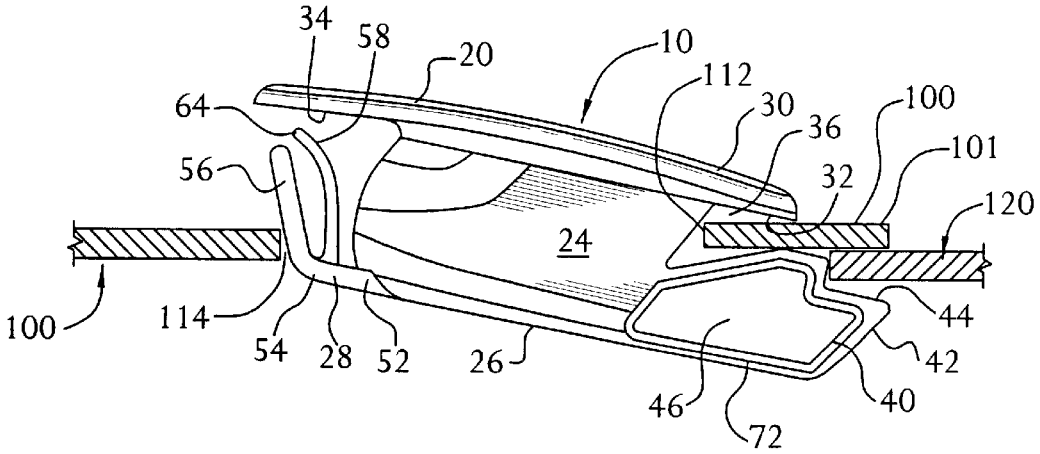
FIG. 8 is a side elevational view of the slide latch of FIG. 1 showing the slide latch being mounted in the panel opening
Figure 9:
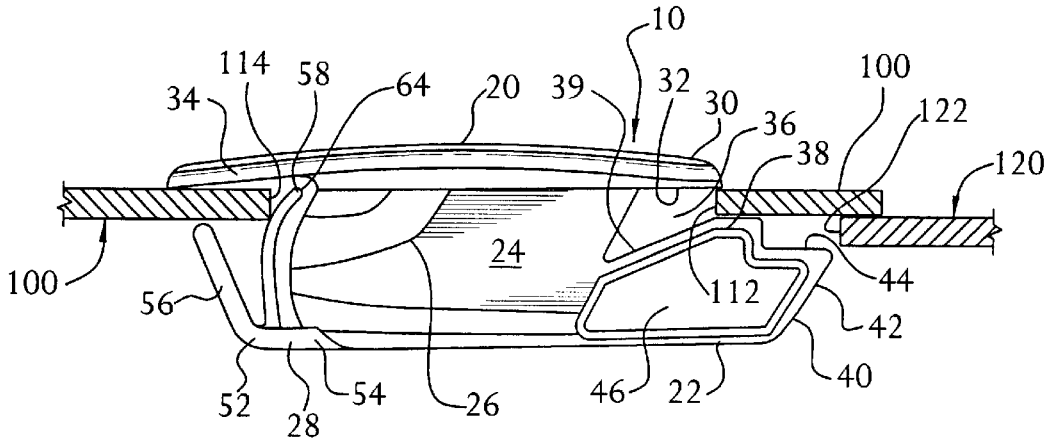
FIG. 9 is a side elevational view of the slide latch of FIG. 1, the slide latch being shown in an open position with the spring compressed and the front portion of the slide latch being disengaged from the frame so that the door can be opened.

As best seen in FIGS. 5 and 6, the rear section 28 of the latch body 20 extends rearwardly from the bottom 26 of the main section 24. The rear section 28 includes a leg element 52 and a spring means 58. The leg element 52 has a generally planar first section 54 which extends generally rearwardly from the bottom 26 of the main section and generally parallel to the plane of the door panel 100 in which the latch 10 is mounted. The leg element 52 also has a generally planar second section 56 which extends from the rear of the first section 54 generally upwardly and outwardly from the first section 54. The second section 56 is spaced rearwardly from the main section 24 of the latch body 20. As best seen in FIGS. 1, 8 and 9, the upper end 60 of the second section 56 is spaced downwardly from the underside 32 of the flange 30 forming a gap sized to receive the panel 100 when the latch 10 is installed in the panel opening 110. The second section 56 of the leg element 52 is thus adapted to engage the bottom of the door panel proximate the rear edge 114 of the panel opening 110.

The spring means 58 of the rear section 28 of the latch body 20 is integrally formed with the latch body 24 so as to form a single unit with the latch body, i.e., monolithic, and extends upwardly and rearwardly from the upper surface 62 of the first section 54 of the leg element 52, between the main section 24 of the latch body 20 and the second section 56 of the leg element 52. The spring means 58 is a leaf spring having a generally planar form, but curving rearwardly, and formed such that the upper end 64 of the spring means is positioned between the underside 32 of the flange 30 and the upper end 60 of the second section 56 of the leg element 52.

As shown in FIG. 8, the latch 10 is installed in a suitably sized generally rectangular opening 110 in the door panel 100 by inserting the forward section 22 of the latch body 20 into the opening 110 and pushing forward so that the front edge 112 of the panel opening 110 slides through the gap formed by the underside 32 of the flange 30 and the upper surface 39 of the first portion 38 of the forward section 22 and then into the shaped recess 36 in the forward section 22. The rear of the latch body 20 is then pressed down, thereby forcing the rear edge 114 of the panel opening 110 against the second section 56 of the leg element 52, and thereby forcing the second section 56 forwards. As shown in FIG. 1, as the underside 32 of the flange 30 engages the top of the panel 100 proximate the rear edge 114 of the opening 110, the second section 56 is released from the rear edge 114 and engages the underside of the panel 100, and the upper end of the 64 of the spring means 58 engages the rear edge 114 of the panel opening 110.

To operate the latch 10, the operator simply places a finger in the well 48 and pulls the latch body 20 rearward. As the latch body 20 travels rearwards, the spring means 58 is forced against the rear edge 114 of the panel opening, with the upper end 64 of the spring means 58 being forced upward and forward by the rear edge 114. The underside 32 of the flange 30 has a recess 34 formed at the rear of the latch body 20—to permit free travel of the spring means 58 as the latch 10 is operated. The underside 32 of the flange 30 is slightly angled upwardly at the front thereof so that the flange 30 does not contact the top surface of the door panel 100 when the latch 10 is operated, thereby advantageously avoiding undesirable wear marks on the upper surface 101 of the panel 100. As shown in FIG. 9, when the latch body 20 has been pulled sufficiently far rearward, the forward section 22 of the latch body 20 clears the edge 122 of the frame 120 so that the door can be opened, however, the front edge 112 of the door panel 100 is retained between the flange 30 and the forward section 22 of the latch body.

The latch of the present invention may be adapted to be engaged by the operator in a different manner. For example, instead of a well formed in the latch body, the latch can include a post or button extending up above the upper surface of the flange to be grasped by the operator (not shown).

Various other modifications can be made in the details of the various embodiments of the apparatus of the present invention, all within the scope and spirit of the invention and defined by the appended claims.

I claim:

1. A latch of the sliding-action slam type for installation in an opening in a door panel for releasably retaining the door panel relative to a frame, the panel having a forward edge and a rear edge formed by the opening, the latch being moveable between a closed position and an open position when installed in the opening in the door panel, the latch comprising a latch body;

a) the latch body having a forward section, a main section having a bottom; a rear section; and a peripheral flange for engaging the top of the door panel proximate the opening, the flange having an underside;

b) the latch body having a shaped recess in the forward section for receiving cooperatively the forward edge of the panel formed by the panel opening;

c) the forward section having a first portion which projects forwardly beyond the shaped recess for retaining the latch body in the panel and for guiding the latch body in its back-and-forth sliding action;

d) the forward section having a second portion which projects forwardly beyond the first portion, the second portion being adapted to cooperate with the frame when the latch body is in its closed position to maintain said door panel in latched position relative to the frame;

e) the rear section having a leg element, the leg element having a first section having an upper surface and extending generally rearwardly from the bottom of the main section, the leg element having a second section extending generally upwardly from the first section and being spaced rearwardly from the main section of the latch body and being spaced downwardly from the flange, the second section being adapted to engage the bottom of the panel proximate the rear edge of the panel opening;

f) wherein the latch body includes a spring means formed monolithically with the latch body for biasing the latch body forwardly toward the closed position, the spring means extending upwardly from the upper surface of the first section of the leg element, and between the main section of the latch body and the second section of the leg element, the spring means being adapted for engaging the rear edge of the panel opening.

2. A latch according to claim 1 wherein the spring means is a leaf spring extending in a generally planar form from the leg element.

3. A latch according to claim 2 wherein the leaf spring curves rearwardly.

4. A latch according to claim 3 wherein the underside of the flange is recessed to permit free travel of the spring as the latch moves between an open position and a closed position.

5. A latch according to claim 1 wherein a well is formed in the main section for receiving the finger of an operator.

6. A latch according to claim 1 wherein the latch is formed from a polymeric material.

7. A latch according to claim 6 wherein the latch is molded from a synthetic acetal resin.

8. A latch according to claim 6 wherein the latch is formed from a polymeric material resistant to cyclic loading.

9. A latch of the sliding-action slam type for installation in an opening in a door panel for releasably retaining the door panel relative to a frame, the panel having a forward edge and a rear edge formed by the opening, the latch being moveable between a closed position and an open position when installed in the opening in the door panel, the latch comprising a latch body;

a) the latch body having a forward section, a main section having a bottom; a rear section; and a peripheral flange for engaging the top of the door panel proximate the opening, the flange having an underside;

b) the latch body having a shaped recess in the forward section for receiving cooperatively the forward edge of the panel formed by the panel opening;

c) the forward section having a first portion which projects forwardly beyond the shaped recess for retaining the latch body in the panel and for guiding the latch body in its back-and-forth sliding action;

d) the forward section having a second portion which projects forwardly beyond the first portion, the second portion being adapted to cooperate with the frame when the latch body is in its closed position to maintain said door panel in latched position relative to the frame;

e) the rear section having a leg element, the leg element having a first section having an upper surface and extending generally rearwardly from the bottom of the main section, the leg element having a generally planar second section extending generally upwardly from the first section and being spaced rearwardly from the main section of the latch body and being spaced downwardly from the flange, the second section being adapted to engage the bottom of the panel proximate the rear edge of the panel opening;

f) wherein the latch body includes a generally planar spring means formed monolithically with the latch body for biasing the latch body forwardly toward the closed position, the spring means extending upwardly from the upper surface of the first section of the leg element, and between the main section of the latch body and the second section of the leg element, the spring means being adapted for engaging the rear edge of the panel.

10. A latch according to claim 9 wherein the spring means is a leaf spring extending in a generally planar form from the leg element.

11. A latch according to claim 10 wherein the leaf spring curves rearwardly.

12. A latch according to claim 11 wherein the underside of the flange is recessed to permit free travel of the spring as the latch moves between an open position and a closed position.

13. A latch according to claim 9 wherein a well is formed in the main section for receiving the finger of an operator.

14. A latch according to claim 9 wherein the latch is formed from a polymeric material.

15. A latch according to claim 14 wherein the latch is molded from a synthetic acetal resin.

16. A latch according to claim 14 wherein the latch is formed from a polymeric material resistant to cyclic loading.

* * * * *